US006110847A

United States Patent [19]

Yamamoto et al.

[11] Patent Number: 6,110,847

[45] Date of Patent: Aug. 29, 2000

[54] CARBON FIBER WOVEN FABRIC

[75] Inventors: Iwao Yamamoto; Akihiko Yoshiya, both of Kagawa; Akira Nakagoshi, Tokyo, all of Japan

[73] Assignee: Mitsubishi Chemical Corporation, Tokyo, Japan

[21] Appl. No.: 09/115,696

[22] Filed: Jul. 15, 1998

[30] Foreign Application Priority Data

Jul. 15, 1997 [JP] Japan ..... 9-189481
Aug. 11, 1997 [JP] Japan ..... 9-216380

[51] Int. Cl.[7] ..... B32B 5/02; B29D 28/00

[52] U.S. Cl. ..... 442/179; 139/426 R; 423/447.1; 423/448; 264/103

[58] Field of Search ..... 442/179; 139/426 R; 423/447.1, 448; 264/103

[56] References Cited

U.S. PATENT DOCUMENTS

| | | | |
|---|---|---|---|
| 5,213,677 | 5/1993 | Yamamoto et al. | 208/39 |
| 5,266,294 | 11/1993 | Schulz et al. | 423/447.1 |
| 5,348,719 | 9/1994 | Yamamoto et al. | 423/447.4 |
| 5,601,794 | 2/1997 | Yamamoto et al. | 423/447.2 |
| 5,643,546 | 7/1997 | Yamamoto et al. | 423/447.2 |
| 5,700,342 | 12/1997 | Giannetti | 156/245 |
| 5,721,308 | 2/1998 | Yamamoto et al. | 524/495 |

FOREIGN PATENT DOCUMENTS

| | | |
|---|---|---|
| 0 383 614 | 8/1990 | European Pat. Off. . |
| 0 713 934 | 5/1996 | European Pat. Off. . |

OTHER PUBLICATIONS

Runnacles et al., "Heat Treatment of Mesophase Pitch Based Low/IntermediateModulus Fibers for C–C Applications", pp. 33–53, 1992.

Derwent Abstracts, AN 96–075517, JP 07 331536, Dec. 19, 1995.

Derwent Abstracts, AN 97–363312, WO 97/22741, Jun. 26, 1997.

Derwent Abstracts, AN 92–420867, JP 04 317465, Nov. 9, 1992.

Derwent Abstracts, AN 95–291021, JP 07 189073, Jul. 25, 1995.

Derwent Abstracts, AN 98–049023, JP 09 298260, Nov. 18, 1997.

*Primary Examiner*—Christopher Raimund
*Attorney, Agent, or Firm*—Oblon, Spivak, McClelland, Maier & Neustadt, P.C.

[57] ABSTRACT

A carbon fiber woven fabric constituted by carbon fibers having a thermal conductivity of at least 400 W/m·K in the fiber axial direction, which has a FAW (weight per unit area of fabric) of at lest 400 g/m$^2$.

8 Claims, No Drawings

CARBON FIBER WOVEN FABRIC

The present invention relates to a carbon fiber woven fabric and a process for its production. The carbon fiber woven fabric of the present invention is constituted by carbon fibers having a high thermal conductivity, and it is suitable, for example, for a heat sink material for electronic parts with high energy densities.

High performance carbon fibers are generally classified in to PAN type carbon fibers made of polyacrylonitrile (PAN) as starting material and pitch type carbon fibers made of pitches as starting material, and they are, respectively, widely used as materials for air crafts, materials for sporting goods, materials for building and construction and materials for space technology, by virtue of their high specific strength and high modulus.

In recent years, along with progress in high densification of electronic parts, importance of materials capable of efficiently removing generated heat (heat sink plates), is increasing. Especially in the aerospace field, the demand is high for light weight materials, and use of a carbon fiber-reinforced plastic (CFRP) is being studied.

This material (CFRP) is required to have high thermal conductivity. Accordingly, carbon fibers constituting it, are desired to have high thermal conductivity, and carbon fibers having high thermal conductivity have been developed for this purpose. For example, JP-A-2-242919 (U.S. Pat. No. 5,266,295) discloses carbon fibers having a thermal conductivity of higher than 1,000 W/m·K, and JP-A-7-331536 (U.S. Pat. No. 5,721,308) discloses carbon fibers having a thermal conductivity of from 500 to 1,500 W/m·K. The thermal conductivities reported here, are all thermal conductivities of the carbon fibers themselves in their axial direction.

However, when practically used, for example, as a heat sink plate, they are used in the form of CFRP, as mentioned above. Accordingly, high thermal conductivity is required as of CFRP, not as of the carbon fibers themselves.

In general, to remove a heat entering from a plane direction as used as a heat sink plate, high thermal conductivity is required from the surface contacted with a heat-generating section to a cooling section. Namely, CFRP having high thermal conductivity in the thickness direction is effective for removing the heat, as the cross sectional area contributing to thermal conduction is thereby broad.

With conventional carbon fibers, the yield (weight per unit length) of the carbon fibers is small, although the thermal conductivity is high. Accordingly, it is thereby possible to produce only a thin prepreg. For example, in Examples of said U.S. Pat. No. 5,721,308, a carbon fiber woven fabric having a FAW (Fiber Areal Weight: weight per unit area of fabric) of 80 g/m$^2$, is disclosed. To prepare CFRP useful as a heat sink plate from such carbon fibers, it is necessary to laminate a few to a few tens prepregs or woven fabrics, followed by molding.

Accordingly, the resulting CFRP may be excellent in the thermal conductivity in the fiber-alignment direction, but the thermal conductivity in the lamination direction is very low (usually at most 1/100 of the thermal conductivity in the fiber axial direction). As a result, among carbon fibers constituting CFRP, only a limited layer which is in contact with the heat generating section, will contribute to removal of the heat, thus establishing a system having a very poor efficiency. Further, for this reason, an excessive demand for thermal conductivity has been put on carbon fibers themselves, thus leading to a limit in the ability of carbon fibers or an increase of costs, which, in turn, has caused a delay in practical application.

As described above, a study has been made for application of CFRP to e.g. a heat sink plate, but the thermal conductivity of carbon fibers has not efficiently been utilized, as mentioned above, whereby it has been required to use carbon fibers having very high thermal conductivity, and such requires very high costs, whereby practical application has been difficult.

Under these circumstances, CFRP having a system whereby the thermal conductivity of carbon fibers is efficiently utilized, and a carbon fiber woven fabric which is useful as a material for such CFRP, are desired.

Specifically, a carbon fiber woven fabric has been desired whereby CFRP having a thermal conductivity equivalent to conventional products, can be produced at a low cost with carbon fibers having lower thermal conductivity, or when carbon fibers having very high thermal conductivity equal to the conventional products are used, it is possible to produce a very high value-added heat sink plate having a higher heat removing effect.

The present inventors have conducted an extensive study to solve the above problems and as a result, have found it possible to produce CFRP having a heat removing performance higher than ever, by increasing to a certain level the FAW (weight per unit area of fabric) of "a carbon fiber woven fabric" which has heretofore been believed to have a heat removing efficiency lower than one directional prepreg laminate, since the alignment is poor.

Namely, it has been found that by using a carbon fiber woven fabric having a large FAW prepared by weaving carbon fibers having a large yield, it is possible to obtain CFRP having a predetermined thickness without lamination or with a small number of laminated layers, and as is different from a one directional prepreg laminate, alignment of carbon fibers in a thickness direction appears, whereby the thermal conductivity of carbon fibers can efficiently be utilized, and the heat removing performance as CFRP can be improved in the removal of a heat entering from a plane direction. The present invention has been accomplished on the basis of this discovery.

Namely, it is an object of the present invention to provide a carbon fiber-reinforced plastic (CFRP) which satisfies a high heat removing performance and a high thermal conductivity which are required for a part such as a heat sink plate for electronic parts, and a carbon fiber woven fabric useful as a starting material for producing such CFRP. Such an object can readily be accomplished by a carbon fiber woven fabric constituted by carbon fibers having a thermal conductivity of at least 400 W/m·K in the fiber axial direction, which has a FAW (weight per unit area of fabric) of at least 400 g/m$^2$.

Further, a preferred process for producing such a carbon fiber woven fabric, comprises weaving pitch type carbon fibers having a tensile modulus of at most 80 ton/mm$^2$ and a yield (weight per unit length of fiber strand) of the carbon fiber tow being at least 500 g/km to obtain a woven fabric, and subjecting the woven fabric to graphitization treatment at a temperature of at least 2,800° C.

Now, the present invention will be described in detail with reference to the preferred embodiments.

In the present invention, it is important that the tensile modulus of "the carbon fibers as starting material" is at most 80 ton/mm$^2$, preferably from 40 to 80 ton/mm$^2$, more preferably from 50 to 80 ton/mm$^2$. If the tensile modulus exceeds 80 ton/mm$^2$, breakage of carbon fibers tends to be frequent during the weaving for the production of the carbon fiber woven fabric, whereby it tends to be difficult to prepare a fabric. On the other hand, if the tensile modulus is too low, the carbon fibers themselves tend to undergo a dimensional change during the graphitization at a temperature of at least 2,800° C. after they are formed into a carbon fiber woven fabric, whereby the resulting carbon fiber woven fabric is likely to have a distortion, such being undesirable.

Further, in the present invention, it is important that the yield (weight per unit length of fiber strand) of the carbon fiber tow is at least 500 g/km, preferably from 700 to 5,000 g/km, more preferably from 1,000 to 3,000 g/km. If the yield is less than 500 g/km, it tends to be difficult to prepare a carbon fiber woven fabric having a FAW (weight per unit area of fabric) of at least 400 g/m$^2$. Further, if the yield is too large, the bundle of the carbon fiber tow tends to be too thick that fibers are likely to be caught in a weaving machine, whereby weaving tends to be difficult.

Here, the yield (g/km) is usually determined by the specific gravity (g/cm$^3$) of the carbon fibers, the cross-sectional area ($\mu$m$^2$) of the fibers and the number of carbon fibers constituting a carbon fiber tow. Further, the cross-sectional area of the fibers is determined by the fiber diameter ($\mu$m).

Here, the specific gravity is preferably from 1.9 to 2.3 g/cm$^3$, more preferably from 2.0 to 2.2 g/cm$^3$. If the specific gravity is less than 1.9, the carbon fibers themselves tend to undergo a dimensional change at the time of the graphitization at a temperature of at least 2,800° C. after they are formed into a carbon fiber fabric, whereby the resulting carbon fiber fabric tends to have a distortion, such being undesirable. If it exceeds 2.3, the elastic modulus of the carbon fibers tends to be necessarily high, whereby breakage of the carbon fibers tend to be frequent during the weaving for the production of a carbon fiber fabric, and it tends to be difficult to prepare a fabric.

Further, the fiber diameter is usually from 6 to 20 $\mu$m, preferably from 7 to 15 $\mu$m, more preferably from 8 to 12 $\mu$m. If the fiber diameter is less than 6 $\mu$m, it becomes necessary to increase the number of carbon fibers consisting a carbon fiber tow, and it becomes necessary to increase the scale of the spinning installation. Further, if it exceeds 20 $\mu$m, tow bending is likely to take place at a single (carbon) fiber level at a curved portion during the process, such being undesirable.

The number of carbon fibers constituting a carbon fiber tow is usually from 1,500 to 40,000, preferably from 3,000 to 30,000, more preferably from 5,000 to 20,000. If the number of carbon fibers is less than 1,500, it becomes necessary to increase the diameter of carbon fibers, thus leading to yarn bending in the process, as mentioned above. On the other hand, if it exceeds 40,000, it becomes necessary to increase the scale of the spinning installation or to install a doubling machine, such being undesirable.

Then, in order to obtain a carbon fiber woven fabric of the present invention, the above-mentioned tow of the carbon fibers as starting material is woven by means of e.g. a shuttle loom or a repier loom to preliminarily obtain a woven fabric of e.g. plain weave or satin weave.

At that time, the FAW (Fiber Areal Weight: weight per unit area of fabric) is required to be at least 400 g/m$^2$, preferably from 500 to 2,000 g/m$^2$, more preferably from 500 to 1,000 g/m$^2$. If the FAW is less than 400 g/m$^2$, it will be necessary to laminate a number of fabrics to prepare CFRP, whereby the thermal conductivity in a thickness direction tends to be poor, such being undesirable. On the other hand, if the FAW is too large, the CFRP plate tends to be too thick, depending upon the particular purpose, such being undesirable.

Then, this carbon fiber woven fabric as starting material is graphitized to obtain a carbon fiber woven fabric of the present invention. For the graphitization, it is preferred that the woven fabric is put into a crucible made of graphite and subjected to graphitization treatment, since it is thereby possible to shield any physical or chemical action from exterior. The graphite crucible is not particularly limited with respect to its size or shape, so long as a desired amount of the above-mentioned carbon fiber woven fabric as starting material may be put therein. However, in order to prevent damage of the carbon fiber woven fabric due to the reaction with carbon vapor or an oxidative gas in the graphite furnace during the graphitization treatment or during cooling, a highly air-tight crucible with a lid, is preferred.

The graphitization treatment is carried out at a temperature at which the thermal conductivity of carbon fibers constituting the resulting carbon fiber woven fabric would become at least 400 W/m·K, preferably at least 500 W/m·K, more preferably at least 550 W/m·K. If the thermal conductivity is lower than 400 W/m·K, no adequate heat dissipation performance tends to be obtained, for example, when a heat sink plate is prepared therefrom. The graphitization temperature required to obtain a thermal conductivity of at least 400 W/m·K, is usually at least 2,800° C., preferably from 2,800 to 3,500° C., more preferably from 2,800 to 3,300° C. If it is lower than 2,800° C., the thermal conductivity of carbon fibers tends not to reach 400 W/m·K, such being undesirable. On the other hand, if the graphitization temperature is too high, sublimation of "carbon" tends to start and may present a serious damage to the product and to the furnace body.

With respect to the graphitization time, the retention time at a temperature of at least 2,800° C. is usually from 10 minutes to 100 days, preferably from 30 minutes to 30 days.

The installation for the graphitization treatment is not particularly limited so long as treatment can be carried out at a temperature of at least 2,800° C. However, from the viewpoint of the production efficiency, it is preferred to employ an Acheson resistance heating furnace.

Thus, it is possible to obtain a carbon fiber woven fabric of the present invention. Such a carbon fiber woven fabric usually has good tensile strength and tensile modulus. Namely, the tensile strength is usually at least 300 kg/mm$^2$, preferably at least 350 kg/mm$^2$, and the tensile modulus is usually at least 80 ton/mm$^2$, preferably at least 90 ton/mm$^2$.

Further, it is possible to obtain a carbon fiber-reinforced plastic (CFRP) by impregnating a thermosetting resin to such a carbon fiber woven fabric in accordance with a conventional method, followed by molding and curing. The matrix resin to be impregnated, may, for example, be a thermosetting resin such as an epoxy resin, a polyamide resin, a phenol resin, a vinyl ester resin or an unsaturated polyester resin, preferably an epoxy resin, a polyamide resin or a phenol resin. Further, as the matrix, a metal matrix such as copper or aluminum may be employed instead of a plastic. The molding and the curing may be carried out by a RTM (Resin Transfer Molding) method, a hand lay up or spray up open mold method, a pressing method, an autoclave method, a filament winding method, a pultrusion method or an extrusion method. Preferred is a RTM method.

CFRP thus obtained usually comprises from 30 to 75 vol % of carbon fibers and from 25 to 70 vol % of a resin. CFRP of the present invention is usually in the form of a sheet, which may be cut into a suitable size depending upon the particular purpose. The thickness of CFRP is usually from 0.2 to 50 mm, preferably from 0.4 to 20 mm. In CFRP, the woven fabric is usually disposed substantially in parallel with the sheet plane. The woven fabric to be used for CFRP may be a single sheet or a plurality of sheets in a laminated form.

Such CFRP has high thermal conductivity, and it can be used particularly suitably, for example, as a heat sink plate for electronic parts such as substrates for IC where a temperature rise is directly related to breakage of an element or deterioration in efficiency.

The "carbon fibers as starting material" for a carbon fiber woven fabric of the present invention, are not particularly limited so long as they satisfy the tensile modulus and the yield, as defined above, and in the above-mentioned graphitization treatment, the thermal conductivity after the final graphitization, becomes at least 400 W/m·K. However, it is preferred to employ pitch type carbon fibers produced by the following method, since high thermal conductivity can thereby readily be obtained.

As a starting material for spinning pitch, coal-originated coal tar, coal tar pitch or coal liquid, or petroleum-originated heavy oil, tar or pitch, may, for example, be mentioned. Among these starting materials, coal-originated coal tar or coal tar pitch is preferred from such a viewpoint that the aromaticity of molecules constituting it, is high, and spinning pitch is obtainable wherein graphite crystals will readily develop.

Such carbonaceous starting material contains impurities such as free carbon, non-unsoluble coal, ash and a catalyst. It is advisable to preliminarily remove such impurities by a well-known method such as filtration, centrifugal separation or a sedimentation separation employing a solvent. Further, such carbonaceous material may be subjected to pretreatment, for example, by a method of extracting soluble contents with a specific solvent after heat treatment, or a method of carrying out hydrogenation treatment in the presence of a hydrogen-donative solvent or hydrogen gas. The proportion of optical anisotropy of optically anisotropic pitch as spinning pitch, is usually at least 70%, preferably at least 90%, more preferably 100%. If the proportion of optical anisotropy is lower than 70%, the graphite crystallinity of carbon fibers after the graphitization is low, whereby high thermal conductivity is hardly obtainable.

Further, the softening point obtained by a Mettler method is usually from 260° C. to 340° C., preferably from 280° C. to 320° C., more preferably from 290° C. to 310° C. If the softening point is lower than 260° C., fusion of fibers to one another is likely to take place during stabilizing process after spinning, to form carbon fiber bundles which can hardly be dispersed. Further, if it is higher than 340° C., pitch is likely to undergo thermal decomposition during spinning, and the spinning efficiency substantially decreases due to formation of bubbles in the spinning nozzles due to the decomposition gas.

In order to obtain an optically anisotropic pitch having the desired proportion of optical anisotropy and the desired Mettler softening point, the above-mentioned carbonaceous material or the pre-treated carbonaceous material may be subjected to heat treatment usually at a temperature of from 350 to 500° C., preferably from 380 to 450° C., for from 2 minutes to 50 hours, preferably from 5 minutes to 5 hours, in an atmosphere or in a stream of an inert gas such as nitrogen, argon or steam as the case requires.

Then, this spinning pitch is melt-span to obtain pitch fibers. In spinning of the present invention, it is necessary to determine the fiber diameter and the number of fibers, so that the size of the finally obtainable carbon fiber tow would be at least 500 g/km, as described above.

The obtained pitch fibers are stabilized by a common method and then subjected to carbonization and/or graphitization at a desired temperature. Then, a sizing agent is deposited thereon to obtain the "carbon fibers as starting material" for the carbon fiber woven fabric of the present invention.

The stabilizing treatment is usually carried out in an oxidizing atmosphere of e.g. air, ozone or nitrogen dioxide, or in a rare case, in an oxidizing liquid by means of e.g. nitric acid. As the most convenient method, it can be carried out in air. Specifically, pitch fibers are heated at a temperature of from 300 to 400° C. in an oxidizing gas atmosphere to obtain an stabilized fiber tow.

Further, this stabilized fiber tow is carbonized or graphitized at a temperature of from 800 to 2,800° C. in an inert gas atmosphere of e.g. nitrogen or argon. At that time, a tension may or may not be imparted.

The sizing agent is deposited in an amount of from 0.2 to 10 wt %, preferably from 0.5 to 7 wt %, based on the fibers. Prior to the deposition of the sizing agent, the surface treatment may or may not be applied to the carbon fibers themselves. If the sizing agent is less than 0.2%, "fuzz" tends to form during the weaving, and if it exceeds 10%, the fibers themselves tend to be covered with a carbide of the sizing agent upon graphitization in the subsequent step, whereby flexibility as a woven fabric will be lost, such being undesirable.

As the sizing agent, any optional sizing agent which is commonly used, may be employed. Specifically, an epoxy compound, a water-soluble polyamide compound, a saturated or unsaturated polyester, vinyl acetate, water or an alcohol, or glycol alone or a mixture thereof may, for example, be mentioned.

Now, the present invention will be described in further detail with reference to Examples. However, it should be understood that the present invention is by no means restricted to such specific Examples. In the Examples, the thermal conductivity of carbon fibers was calculated from the electric resistivity in accordance with the following formula, utilizing a very good interrelation between the thermal conductivity and the electrical resistivity of the carbon fibers:

$$K=1272.4/ER-49.4$$

(wherein K is the thermal conductivity (W/m·K) of the carbon fibers, and ER is the electrical resistivity ($\mu\Omega$m) of the carbon fibers.

EXAMPLE 1

From coal tar pitch, a mesophase pitch was prepared which had a proportion of optical anisotropy being 100% as observed under a polarization microscope and a softening point of 302° C. as obtained by a Mettler method.

This mesophase pitch was introduced into a spinneret having a total of 10,000 nozzles to carry out continuous spinning. The fiber diameter of the obtained pitch fibers was about 12 $\mu$m, and the number of fibers constituting a tow was about 10,000. The obtained pitch fibers were stepwise heated to 380° C. in air to carry out stabilizing treatment, then graphitization was continuously carried out, finally to 2,500° C. in argon gas, and then an epoxy type sizing agent was deposited in an amount of 2%. The obtained carbon fibers had a fiber diameter of about 10 $\mu$m, a tensile modulus of 64 ton/mm$^2$, a tensile strength of 300 kg/mm$^2$, a thermal conductivity of 140 W/m·K and a carbon fiber tow had a yield of 1,420 g/km.

Then, using the carbon fibers, warps and wefts were crosswise woven with 7 tows per 25 mm by a repier loom, to obtain a carbon fiber woven fabric having FAW 790 g/m$^2$.

Then, the obtained carbon fiber woven fabric was put into a graphite crucible and graphitized at 3,000° C. in an Acheson resistance heating furnace. The retention time at 3,000° C. was 1 hour.

FAW of the obtained carbon fiber woven fabric was 794 g/m$^2$. The thermal conductivity of carbon fibers withdrawn from the carbon fiber woven fabric was measured and found to be 600 W/m·K. Further, the tensile strength was 360 kg/mm$^2$, and the tensile modulus was 92 ton/mm$^2$.

Comparative Example 1

Commercially available carbon fibers Dialed K13C2U were obtained. The obtained carbon fibers had a diameter of about 9 $\mu$m, a tensile modulus of 94 ton/mm$^2$, a tensile strength of 380 kg/mm$^2$, a thermal conductivity of 620 W/m·K and a carbon fiber tow had a yield of 270 g/km.

Then, with these carbon fibers, weaving was attempted by the same repier loom as used in Example 1, but breakage of fibers took place frequently, whereby weaving was impossible.

Comparative Example 2

In the same manner as in Example 1, carbon fiber tow having a yield of 1,420 g/km, a tensile modulus of 64 ton/mm$^2$ and a tensile strength of 300 kg/mm$^2$, were prepared. The carbon fibers were wound up on a graphite bobbin, put into a graphite crucible and then graphitized at 3,000° C. in an Acheson resistance heating furnace. The retention time at 3,000° C. was 1 hour.

The thermal conductivity of the obtained carbon fibers was 600 W/m·K, the tensile strength was 360 kg/mm$^2$, and the tensile modulus was 92 ton/mm$^2$.

Then, with these carbon fibers, weaving was attempted by the same repier loom as used in Example 1, but breakage of fibers took place frequently, whereby weaving was impossible.

EXAMPLE 2

An epoxy resin was impregnated to one sheet of the carbon fiber woven fabric obtained in Example 1, followed by molding, curing and cutting, and then a heat sink plate made of a carbon fiber-reinforced plastic of 280 mm in length×30 mm in width×0.7 mm in thickness, was prepared.

At its end, an aluminum block of 35 mm in length×30 mm in width×10 mm in thickness, heated to 133° C., was contacted. The time required for the surface temperature of the aluminum block to drop to 40° C., was 7 minutes.

Comparative Example 3

Using the same carbon fibers Dialed K13C2U as used in Comparative Example 1, a one-directional prepreg with FAW=160 g/m$^2$, was prepared. Five sheets of this prepreg were laminated, followed by molding, curing and cutting, and then a heat sink plate made of a carbon fiber-reinforced plastic of 280 mm in length×30 mm in width×0.7 mm in thickness, was prepared.

To its end, an aluminum block of 35 mm in length×30 mm in width×10 mm in thickness, heated to 133° C., was contacted. The time required for the surface temperature of the aluminum block to drop to 40° C., was 10 minutes.

Comparative Example 4

The same mesophase pitch as used in Example 1, was introduced into a spinneret having a total of 2,000 nozzles to carry out continuous spinning. The fiber diameter of the obtained pitch fibers was about 9.5 $\mu$m. The obtained pitch fibers were stepwise heated to 380° C. in air to carry out stabilizing treatment, then graphitization was continuously carried out, finally to 2,500° C. in argon gas, and an epoxy type sizing agent was deposited in an amount of 2%. The obtained carbon fibers had a fiber diameter of about 7 $\mu$m, a yield of 140 g/km, a tensile modulus of 62 ton/mm$^2$ and a tensile strength of 360 kg/mm$^2$.

Then, using the carbon fibers, warps and wefts were crosswise woven with 7 tows per 25 mm by a repier loom to obtain a carbon fiber woven fabric with FAW=80 g/m$^2$.

Then, the obtained carbon fiber woven fabric was put into a graphite crucible and graphitized at 3,000° C. in an Acheson resistance heating furnace. The retention time at 3,000° C. was 1 hour.

FAW of the obtained carbon fiber woven fabric was 82 g/m$^2$. The thermal conductivity of carbon fibers withdrawn from the carbon fiber woven fabric, was measured and found to be 600 W/m·K. Further, the tensile strength was 380 kg/mm$^2$, and the tensile modulus was 90 ton/mm$^2$.

An epoxy resin was impregnated to this carbon fiber fabric, and 10 sheets of such an impregnated fabric were laminated, followed by molding, curing and cutting, and then a heat sink plate made of a carbon fiber-reinforced plastic of 280 mm in length×30 mm in width×0.7 mm in thickness, was prepared.

To its end, an aluminum block of 35 mm in length×30 mm in width×10 mm in thickness, heated to 133° C., was contacted. The time required for the surface temperature of the aluminum block to drop to 40° C., was 13 minutes.

Comparative Example 5

To a slate plate of 280 mm in length×30 mm in width×0.7 mm in thickness composed essentially of asbestos, an aluminum block of 35 mm in length×30 mm in width×10 mm in thickness, heated to 133° C., was contacted. The time required for the surface temperature of the aluminum block to drop to 40° C., was 23 minutes.

According to the present invention, it is possible to provide a carbon fiber-reinforced plastic which satisfies high heat removing performance and high thermal conductivity, which are required for a part such as a heat sink plate for electronic parts, and a carbon fiber woven fabric useful as a starting material for the production of such a carbon fiber-reinforced plastic.

What is claimed is:

1. A heat sink plate comprising a carbon fiber-reinforced plastic obtained by impregnating one or more layers of a carbon fiber woven fabric with a resin, followed by molding and curing, wherein at least one layer of said carbon fiber woven fabric is constituted by carbon fibers having a thermal conductivity of at least 400 W/m·K in the fiber axial direction, the fabric of said at least one layer having a FAW (weight per unit area of fabric) of at least 400 g/m$^2$.

2. The heat sink plate of claim 1, wherein the FAW is from 500 to 2,000 g/m$^2$.

3. The heat sink plate of claim 1, wherein the carbon fibers have a tensile strength of at least 300 kg/mm$^2$.

4. The heat sink plate of claim 1, wherein said at least one layer has a tensile modulus of at least 80 ton/mm$^2$.

5. The heat sink plate of claim 1, wherein the carbon fiber has a diameter ranging from 6 to 20 $\mu$m.

6. The heat sink plate of claim 5, wherein said fiber diameter ranges from 7 to 15 $\mu$m.

7. The heat sink plate of claim 1, wherein said at least one layer has a tensile strength of at least 300 kg/mm$^2$ and a tensile modulus of at least 80 ton/mm$^2$.

8. A heat sink plate comprising a carbon fiber-reinforced plastic obtained by impregnating one or more layers of a carbon fiber woven fabric with a resin, followed by molding and curing, wherein at least one layer of said carbon fiber woven fabric is constituted of carbon fibers having a thermal conductivity of at least 400 W/m·K in the fiber axial direction, a tensile modulus of at least 80 ton/mm$^2$ and, as a tow of fibers, having a yield of at least 500 g/km, the fabric of said at least one layer having a FAW of at least 400 g/m$^2$.

* * * * *